US006476329B2

(12) United States Patent
Tsukamoto et al.

(10) Patent No.: US 6,476,329 B2
(45) **Date of Patent: *Nov. 5, 2002**

(54) TWISTED FLAT CABLE

(75) Inventors: Yoshinori Tsukamoto, Ibaraki (JP); Fumio Shimizu, Ibaraki (JP); Osamu Mochizuki, Ibaraki (JP); Masaaki Aoyagi, Ibaraki (JP); Satoshi Mizushima, Ibaraki (JP)

(73) Assignee: Hitachi Cable, Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/384,178

(22) Filed: Aug. 27, 1999

(65) Prior Publication Data

US 2002/0084101 A1 Jul. 4, 2002

(30) Foreign Application Priority Data

Apr. 8, 1999 (JP) ..... 11-101410

(51) Int. Cl.[7] ..... H01B 7/08
(52) U.S. Cl. ..... 174/117 F
(58) Field of Search ..... 174/27, 36, 117 F, 174/115, 117 A, 121 A, 110 PM

(56) References Cited

U.S. PATENT DOCUMENTS 4,381,426 A * 4/1983 Cronkite et al. ..... 174/117 F
4,800,359 A * 1/1989 Yukawa et al. ..... 338/214
4,837,405 A * 6/1989 Bonjour et al. ..... 174/36
5,142,105 A * 8/1992 Kihlken et al. ..... 174/117 F X
5,162,609 A * 11/1992 Adriaenssens et al. .. 174/121 A X

OTHER PUBLICATIONS

"C&M corporation", p. 10, 1992.*

* cited by examiner

*Primary Examiner*—Chau N. Nguyen
(74) *Attorney, Agent, or Firm*—Scully, Scott, Murphy & Presser

(57) ABSTRACT

A twisted flat cable is provided which includes parallel fused portions and twisted pair portions alternating with the parallel fused portions. TPO (thermoplastic olefin) is used as an insulating material for an insulative layer that covers conductors to provide separately insulated conductors constituting the parallel fused portions and the twisted pair portions in the twisted flat cable. By virtue of this construction, the twisted flat cable has excellent transmission characteristics.

2 Claims, 1 Drawing Sheet

TWISTED FLAT CABLE

FIELD OF THE INVENTION

The invention relates to a twisted flat cable comprising twisted pair portions and parallel fused portions provided alternately with the twisted pair portions in the longitudinal direction of the cable.

BACKGROUND OF THE INVENTION

Twisted flat cables comprise a plurality of twisted pairs juxtaposed to each other or one another while providing parallel portions at predetermined intervals. The twisted pair is composed of two conductors that are insulated separately and twisted together. The parallel fused portion is composed of separately insulated conductors that extend from the twisted pairs and are disposed side by side with adjacent insulated conductors being fused to each other. The twisted flat cable is advantageous in that the precision of the conductor-conductor dimension is high and a connector for IDC (Insulation Displacement Contact) can be easily attached.

In conventional twisted flat cables, PVC (polyvinyl chloride) has been used as an insulating material for an insulative layer covering the conductor. The structure of the twisted flat cables is generally such that, in order to flatten the cable, the cable is sandwiched between two plastic tapes.

In recent years, however, the transmission characteristics for electronic signals of the twisted flat cables using PVC as the insulating material have been found to be unsatisfactory as advanced hard disk drive interfaces such as SCSI (small computer system interface). It has been pointed out that the unsatisfactory transmission characteristics are, of course, attributable to poor dielectric properties of PVC per se.

The dielectric properties of PVC are specifically such that the dielectric constant is 3 to 8 and the dielectric loss tangent is 4 to 12%. Both the dielectric constant and the dielectric loss tangent depend greatly upon the temperature and the frequency.

SUMMARY OF THE INVENTION

Accordingly, it is an object of the invention to solve the above problem of the prior art and to provide a twisted flat cable possessing excellent transmission characteristics.

According to the first feature of the invention, a twisted flat cable comprises: twisted pair portions; and parallel fused portions provided at predetermined intervals alternately with the twisted pair portions in the longitudinal direction of the cable, said twisted pair portions each being composed of a plurality of twisted pairs juxtaposed to each other or one another, said plurality of twisted pairs each being composed of two conductors, which are separately insulated by an insulative layer formed of an insulating material and are twisted together, said parallel fused portions each being composed of separately insulated conductors which extend from the twisted pair portion and are disposed side by side, adjacent insulated conductors in their respective insulative layers in the parallel fused portion being fused to each other to form a fused portion, said insulating material having a dielectric constant of not more than 2.6 and an oxygen index of not less than 25.

TPO (thermoplastic olefin) is best suited as the insulating material, because TPO can satisfy the above requirements, is stably extrudable, and good fusibility.

BRIEF DESCRIPTION OF THE DRAWING

The invention will be explained in more detail in conjunction with the appended drawings, wherein.

DESCRIPTION OF THE PREFERRED EMBODIMENTS

The twisted flat cable in a preferred embodiment of the invention will be explained in conjunction with FIGS. 1 and 2.

Figure 1:
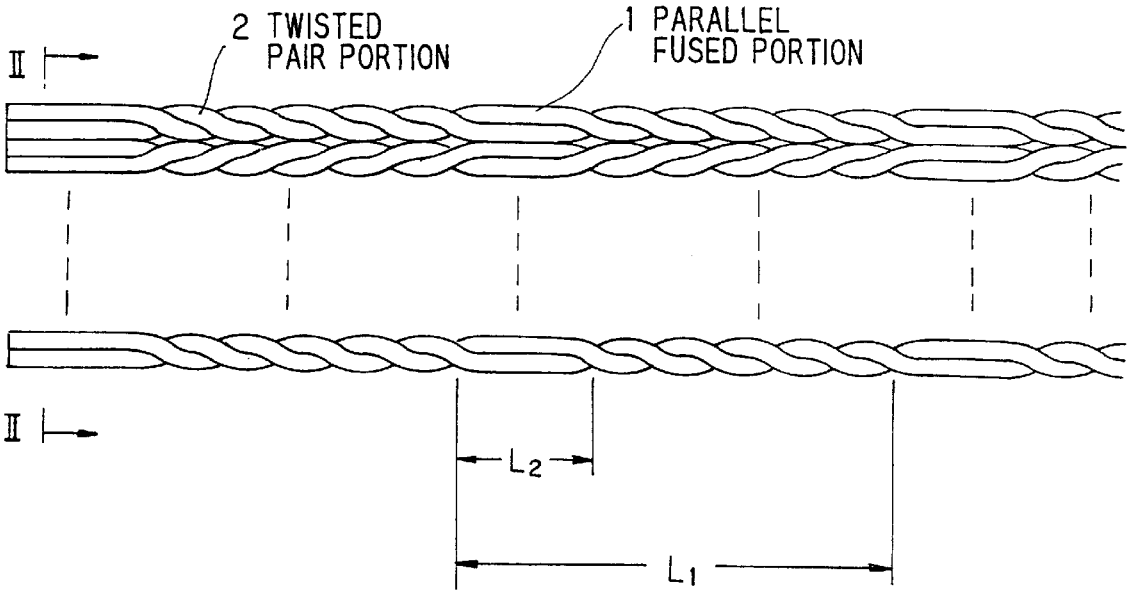
FIG. 1 is an explanatory view of a twisted flat cable according to a preferred embodiment of the invention.
Figure 2:
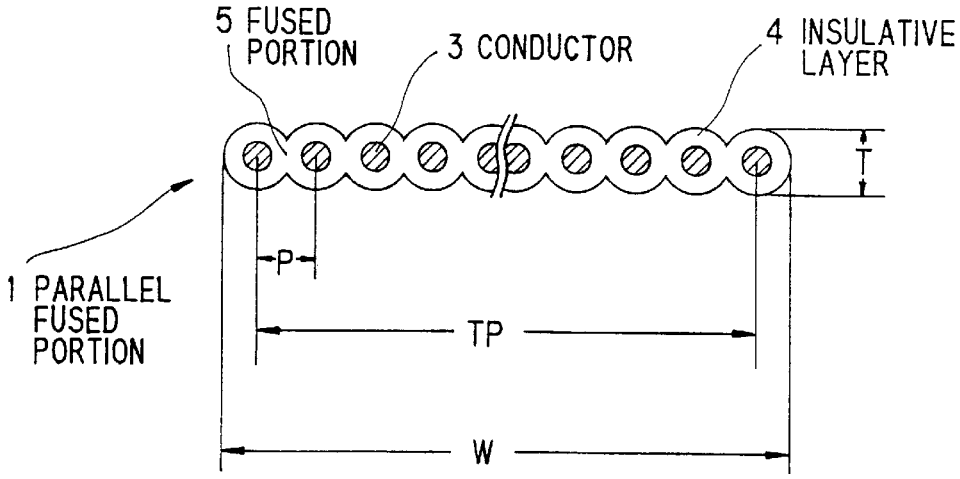
FIG. 2 is a cross-sectional view taken on line II—II of FIG. 1.

FIG. 1 is an explanatory view of a twisted flat cable according to a preferred embodiment of the invention, and FIG. 2 a cross-sectional view taken on line II—II of FIG. 1. In FIG. 1, numeral 1 designates a parallel fused portion of the twisted flat cable, and numeral 2 a twisted pair portion. The cross section of the parallel fused portion 1 is as shown in FIG. 2. The twisted pair portion 2 is composed of a plurality of twisted pairs juxtaposed to each other or one another. The plurality of twisted pairs each are composed of two conductors 3 which are separately insulated by an insulative layer 4 formed of an insulating material and are twisted together. The parallel fused portion 1 is composed of separately insulated conductors which extend from the twisted pair portion and are disposed side by side. Adjacent insulated conductors in their respective insulative layers in the parallel fused portion 1 are fused to each other to form a fused portion 5.

In this preferred embodiment of the invention, a material having better dielectric properties than PVC is used as the material for the insulative layer 4.

Specifically, this material is an insulating material having a dielectric constant of not more than 2.6 (frequency: 1 to 100 MHz). The dielectric constant (and dielectric loss tangent) may be measured according to ASTM Standards D-1531.

The cable should have inflammability on a level which can pass a horizontal flame test (UL Standards UL 1581). For this reason, preferably, the insulating material has an oxygen index of not less than 25. The oxygen index may be measured according to ASTM Standards D-2863.

Further, the insulative layer 4 should have stable extrudability, and have excellent fusibility in the formation of the parallel fused portion.

TPO is best suited as the material satisfying the above requirements.

The following example and comparative example further illustrate the invention.

Example 1

A twisted flat cable usable as SCSI cables for hard disk drives and the like were produced. Regarding insulated wires, the conductor 3 was seven tinned annealed copper wires having a diameter of 0.102 mm that have been twisted around one another, the twisted wire having a size of 30AWG, and the insulative layer 4 was formed of TPO (tradename: TRINITY FR-1HR98, 61N, manufactured by Riken Vinyl Industry Co., Ltd.). TPO had a dielectric constant of 2.40 (frequency: 1 to 100 MHz), a dielectric loss tangent of not more than 1.0% (1 MHz), and an oxygen index of 26.

A twisted flat cable was produced using 34 twisted pairs of this insulated wire. The dimension of the cable was cable thickness T 0.55 mm, conductor-conductor pitch P 0.635 mm, total pitch TP 42.55 mm, cable width W 43.18 mm, cable span length L1 125 mm, and parallel fused portion length L2 about 40 mm.

Comparative Example 1

A twisted flat cable was produced in the same manner as in Example 1, except that PVC was used as the material for the insulative layer 4. This PVC had a dielectric constant of 3.1 to 2.9 at a temperature of 20° C. (frequency: 1 to 100 MHz), a dielectric loss tangent of 8 to 2% (frequency: 1 to 100 MHz), and an oxygen index of 29.0.

Measurement of Transmission Characteristics

The twisted flat cables produced in Example 1 and Comparative Example 1 were evaluated for transmission characteristics. The results are shown in Table 1.

The characteristic impedance was measured with a TDR apparatus (P/N: HP 54120A, HP 54121A) manufactured by Hewlett Packard Co., and the capacitance was measured with an impedance analyzer (P/N: YHP 4192A) manufactured by Yokogawa-Hewlett-Packard, Ltd. and a network analyzer (P/N: HP8753A, HP 85046A) manufactured by Hewlett Packard Co.

As is apparent from Table 1, the twisted flat cable of Example 1 using TPO as the material for the insulative layer had lower capacitance and lower attenuation than the twisted flat cable of Comparative Example 1 using PVC as the material for the insulative layer while enjoying a high characteristic impedance comparable to that of the product of Comparative Example 1.

TABLE 1

| Transmission characteristics | | | |
|---|---|---|---|
| Item | | Comp.Ex. 1 | Ex. 1 |
| Characteristic impedance (TDR) | Single end | 88 Ω | 88 Ω |
| | Differential | 120 Ω | 120 Ω |
| Capacitance, 1 MHz | Between twisted pairs | 42.7 pF/m | 31.0 pF/m |
| | Differential | 44.9 pF/m | 38.0 pF/m |
| Attenunation | 5 MHz | 0.100 dB/m | 0.100 dB/m |
| | 20 MHz | 0.235 dB/m | 0.206 dB/m |
| | 40 MHz | 0.380 dB/m | 0.325 dB/m |
| | 60 MHz | 0.508 dB/m | 0.438 dB/m |
| | 80 MHz | 0.612 dB/m | 0.544 dB/m |
| | 100 MHz | 0.715 dB/m | 0.650 dB/m |

Next, an acidic gas test and a hydrogen chloride gas test were carried out to evaluate environmental friendliness. The results are shown in Table 2. In the acidic gas test, the amount of an acidic gas evolved was measured according to IEC Standards IEC 754-1, and the pH value and the electrical conductivity of the evolved gas was measured according to IEC 754-2. In the hydrogen chloride gas test, the amount of hydrogen chloride gas evolved was measured according to JCS C 53, Paragraph 3.7.

As is apparent from Table 2, the product of Example 1 using an insulative layer of TPO was significantly more environmentally friendly than the product of Comparative Example 1 using an insulative layer of PVC.

TABLE 2

| Environment friendliness | | | | |
|---|---|---|---|---|
| | Acidic gas test | | | Hydrogen chloride gas test |
| | IEC 754-1 | IEC 754-2 | | JCS C 53 |
| | Amount of halogenic acid | pH value | Electrical conductivity | Amount of hydrogen chloride gas evolved |
| Comp. Ex. 1 | 220 mg/g | 2.21 | 0.32 μS/mm | 271 mg/g |
| Ex. 1 | 13.6 mg/g | 3.05 | 0.42 μS/mm | 24 mg/g |

As is apparent from the foregoing description, according to the invention, use of an insulating material having a dielectric constant of not more than 2.6 and an oxygen index of not less than 25 as a material for an insulative layer covering insulated wires in a twisted flat cable can offer transmission characteristics good enough for use of the twisted flat cable as advanced hard disk drives interfaces such as SCSIs.

Further, use of TPO (thermoplastic olefin) as the insulating material can offer, in addition to the above effect, a significant improvement in environment friendliness over the prior art technique.

The invention has been described in detail with particular reference to preferred embodiments, but it will be understood that variations and modifications can be effected within the scope of the invention as set forth in the appended claims.

What is claimed is:

1. A twisted flat cable comprising: twisted pair portions and parallel fused portions provided at predetermined intervals alternately with the twisted pair portions in the longitudinal direction of the cable, said twisted pair portions each being composed of a plurality of twisted pairs juxtaposed to each other or one another, said plurality of twisted pairs each being composed of two conductors, which are separately insulated by an insulative layer formed of an insulating material and are twisted together, said parallel fused portions each being composed of separately insulated conductors which extend from the twisted pair portions and are disposed side by side, adjacent insulated conductors in their respective insulative layers in the parallel fused portion being fused to each other to form a fused portion, said insulating material having a dielectric constant of not more than 2.6 at a frequency of 1 to 100 MHz and an oxygen index of not less than 25, wherein said insulating material is TPO, said TPO being a blend of a polyolefin thermoplastic resin and rubber.

2. A twisted flat cable in accordance with claim 1 wherein said insulative layer is unitary.

* * * * *